United States Patent [19]

Hickam

[11] 4,054,173

[45] Oct. 18, 1977

[54] APPARATUS FOR PRODUCING COMPLETELY RECRYSTALLIZED METAL SHEET

[75] Inventor: Jim Hickam, South Orange, Calif.

[73] Assignee: Hunter Engineering Co., Inc., Riverside, Calif.

[21] Appl. No.: 700,177

[22] Filed: June 28, 1976

Related U.S. Application Data

[62] Division of Ser. No. 535,421, Dec. 23, 1974, abandoned.

[51] Int. Cl.[2] ..... B22D 11/06

[52] U.S. Cl. ..... 164/428

[58] Field of Search ..... 164/87, 277

[56] References Cited

U.S. PATENT DOCUMENTS 3,405,757 10/1968 Harvey et al. ..... 164/87

*Primary Examiner*—Robert D. Baldwin

*Attorney, Agent, or Firm*—Herbert E. Kidder

[57] ABSTRACT

A method and apparatus for producing extremely fine-grained aluminum sheet in a casting machine having a pair of parallel casting rolls, a pouring tip on the entrance side of the rolls, and means for driving the rolls. Molten aluminum is poured through the tip into the space between the rolls, and the rolls are driven at a speed such that solidification of the metal is completed at a point ahead of the centerline of the rolls, and the frozen metal is then hot-rolled down to the thickness of the roll spacing. During this hot-rolling, the metal is heavily stressed internally by being reduced at least 33% of the thickness at the point of solidification, and this destroys the "as cast" crystal structure and causes complete recrystallization to take place. As compared with conventional roll casters, the present caster has larger-diameter casting rolls, which are driven at a faster speed, and the tip is set back further from the rolls centerline. The resultant cast product is vastly superior to anything produced by prior casters.

1 Claim, 1 Drawing Figure

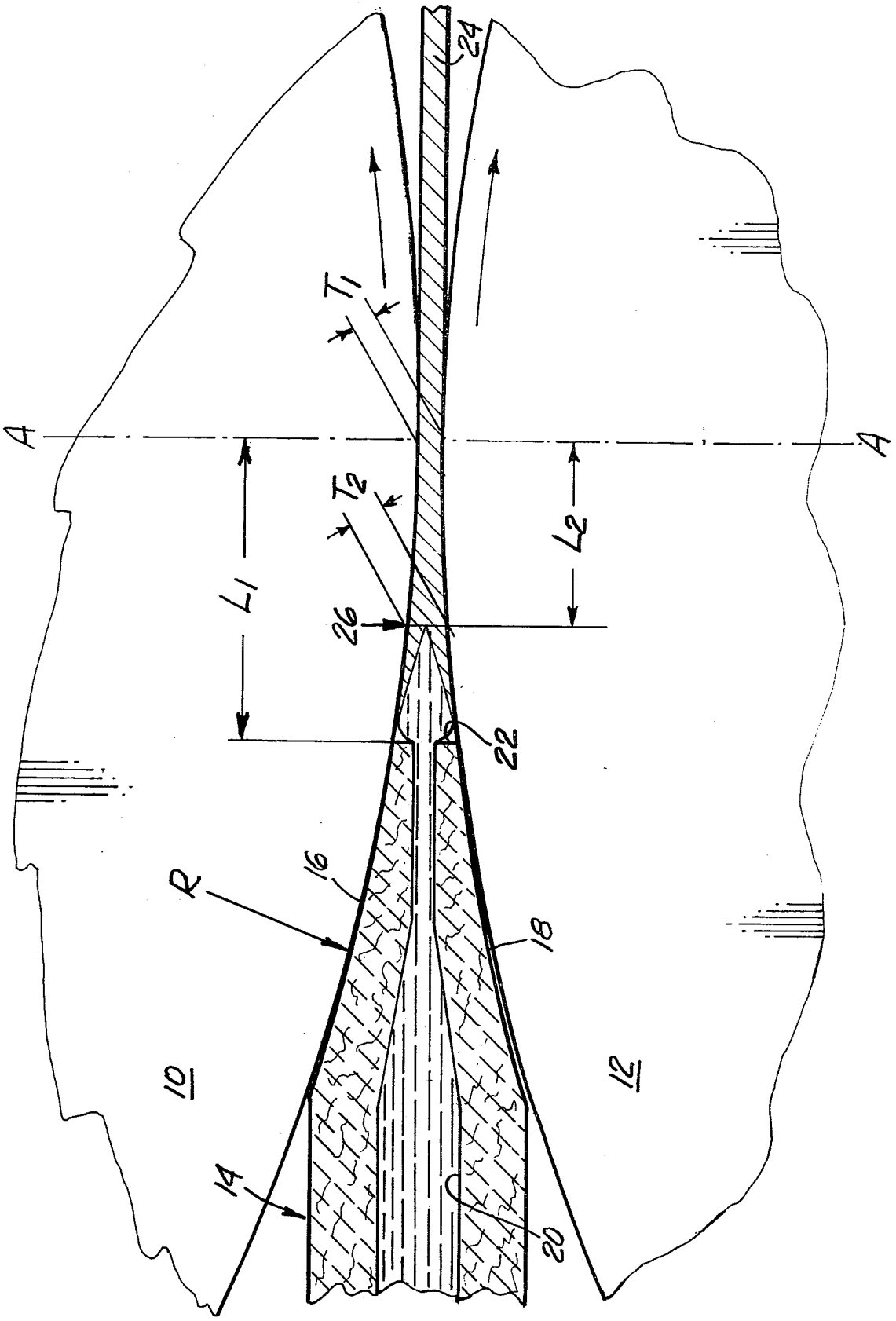
24
T1
A
A
T2
L1
L2
26
22
R
16
18
10
12
14
20

APPARATUS FOR PRODUCING COMPLETELY RECRYSTALLIZED METAL SHEET

This is a division of application Ser. No. 535,421, filed Dec. 23, 1974, now abandoned.

BACKGROUND OF THE INVENTION

The present invention pertains to apparatus for the continuous casting of metals, particularly aluminum and its alloys, and the invention is more particularly concerned with a new and improved form of roll caster and method of operating the same.

The roll casting machine is characterized by a pair of parellel casting rolls which are spaced apart slightly to receive molten metal between them, a pouring tip fitted snugly into the converging space between said casting rolls on the entrance side thereof, and means for driving said rolls. The rolls are usually water-cooled to chill the molten metal and solidify the same. A good example of the prior roll caster described above is shown and described in U.S. Pat. No. 2,790,216, which issued Apr. 30, 1957, to J. L. Hunter.

The Hunter continuous casting machine is well known in the industry, and has enjoyed a large measure of commercial success because it produces a high quality of aluminum strip at a fairly good rate of production. The commercially available Hunter caster has 24-inch diameter rolls and produces 0.250 inch thick strip of the softer aluminum alloys (e.g. alloy No. 1100, for example) at the rate of 40 to 45 inches per minute. In the Hunter caster, complete solidification of the molten metal takes place slightly ahead of the centerline of the rolls, and this solidified metal is then reduced in thickness by some 15 to 20% as the metal advances through the diminishing space between the rolls, until it passes through the roll centerline, where the roll spacing is at the minimum. Thus, the Hunter caster provides simultaneous casting, solidification, and a slight amount of hot rolling, which produces a crystal grain structure that is essentially "as cast" structure, except that the dendrites have been laid down somewhat, and are oriented at an acute angle to the surface, due to the rolling action.

This typical orientation of the crystal structure gave the metal produced by the Hunter caster certain advantages over that produced by other continuous strip casting machines, such as "band casters", but the metal still suffered from many of the handicaps inherent in the "as cast" structure, particularly where subsequent cold work was relatively slight. For example, deep drawing of heavy gauge metal frequently results in severe "earing" of the metal. However, for any application where cold work was sufficient, as in rolling foil, the traditional Hunter cast metal was of excellent quality, and its relatively large, dendrite crystal structure was no handicap.

Before going on to the present invention, it might be well to digress for a moment to discuss what happens to any crystalline metal structure (particularly aluminum and its alloys) during casting, hot working, cold working, and annealing. In conventional casting processes, molten metal is usually poured into or through a mold. Cooling of the molten metal and subsequent solidification is obtained primarily through the mold walls and later, by cooling the metal walls, as with water sprays or air blasts. The resulting "as cast" crystalline structure comprises a relatively thin skin of small-grain structure along the outer surface due to the violent "chill" of the mold; the said skin surrounding the main body of large, needle-shaped dendrite crystals forming the body of the casting; and there being a central inner area where the dendrites growing perpendicular to the mold surface meet. This central inner area is usually an area of heavy segregation of impurities. The grain structure obtained on a "band caster" (e.g., the Hazelett caster) is very similar to the grain structure described above, since the heat transfer and metal solidification follow the same general pattern.

The particular grain structure described above (usually referred to as "as cast" structure), is not suitable for most applications, and to obtain a grain structure suitable for commercial application, the "as cast" structure must be completely destroyed and regenerated through a cycle of deformation (hot or cold rolling), and heat treatment, which produces a phenomenon known as "recrystallization".

When a crystalline metal structure is subjected to sufficient internal stress, the original crystalline structure is fractured. If the material is heated (either instantaneously with the internal stressing or at a later time) to the recrystallization temperature (which, in the case of aluminum alloys will usually be in the range of 650° to 750° F), "centers of recrystallization" are formed along the fractured grain boundaries. The higher the internal stresses, the more centers of recrystallizaion are formed, and the finer the ultimate grain size. The higher the temperature to which the stressed metal is exposed, the quicker the recrystallization takes place. There is also a relationship between stresses required at different temperatures to trigger the recrystallization phenomenon, as heat increases the molecular and crystalline mobility. The finest grain size is achieved with heaviest internal stresses (to produce the largest number of centers of recrystallization) and heating the metal to an elevated temperature just sufficient to give enough time for the newly formed grains to "take over" the full metal volume. If the metal is exposed to the high temperature beyond the optimum time interval, there is a tendency of the larger grains to absorb the smaller grains, with the result that the grain structure becomes larger and coarser.

Recrystallization is customarily achieved by either of two processes: (1) cold rolling, followed by heat treatment; or (2) hot rolling.

In the cold rolling process, hot rolled sheet, with its given grain structure, is cold rolled at varying degrees, usually 35 to 90% total reduction, depending on the metal alloy and the product. The hot rolled grain structure is crushed, and heavy internal stresses are imparted to the metal, but no recrystallization take place (under normal circumstances) because the temperature during the cold rolling cycle is too low, and the metal is in a "frozen" state. The metal is then heat-treated, or annealed, by raising the temperature to a sufficiently high level to cause centers of recrystallization to form. New grains then start to grow around these centers, and if the exposure to high temperature is sufficiently long, the new grain will completely replace the old grain, and the metal will be completely recrystallized.

Hot rolling is usually done to transform cast metal ingots, or slabs, into a thinner sheet product, which may be the finished product, or it may be cold-rolled to finish gauge. The chief benefit of hot rolling is that there is a considerable economy due to energy savings and to reduction of equipment size. If hot rolling is performed at sufficiently high temperatures, and if the reduction ("draft") of a particular rolling pass is sufficient to impart to the metal sufficient internal stresses, then a recrystallization cycle is triggered during and immediately after the rolling cycle.

The original grain structure has a great deal of influence on the final structure, and to eliminate all of the adverse effects from the "as cast" structure (low ductility, elongation, drawability, etc.), the metal must go through an extremely heavy cycle of hot and/or cold work, and repeated recrystallization cycles, until the metal has been completely recrystallized down to the finest possible grain size.

The conventional Hunter casting machines, and all other casting machines known to me at this time, produce what is basically an "as cast" structure, with all of the disadvantages and adverse physical characteristics of "as cast" metal. Metal sheet or strip produced by these machines must be completely recrystallized by a combination of hot and/or cold rolling, together with heat treatment, all of which require expensive equipment, consumption of large amounts of energy, and high labor cost.

SUMMARY OF THE INVENTION

The primary object of the present invention is to provide a new and improved casting machine which is capable of producing a completely recrystallized metal product of superior quality, having an exceedingly fine grain structure that is vastly superior to the metal product produced by any other known caster. In fact the metal produced by the present invention has a grain structure that appears to be equivalent to the grain structure obtained on hot rolled strip of similar gauge produced by conventional slab casting and hot rolling (for example, hot rolling a 16-inch thick slab down to ¼-inch thick strip).

Another object of the invention is to provide a new and unique method of casting metal in a roll caster, which, in one step, produces a fully recrystallized product.

Still a further object of the invention is to provide a casting machine that has a faster rate of output than a conventional roll caster.

These and other objects and advantages of the invention will become apparent to those skilled in the art from the following detailed description of the preferred embodiment thereof, with reference to the accompanying drawing, which shows a fragmentary sectional view through the casting rolls at the point where the pouring tip projects into the space between the rolls.

DESCRIPTION OF THE PREFERRED EMBODIMENT

The roll casting machine of the present invention is generally similar to the casting machine shown in the Hunter patent, except that the two casting rolls 10 and 12 are arranged one above the other, instead of side-by-side. The casting rolls 10 and 12 are parallel to one another, and are spaced apart slightly at the roll centerline A—A. The ends of the rolls are rotatably supported in bearing blocks (not shown) which are mounted on a suitable frame (not shown). The rolls 10, 12 are water cooled, and suitable means (not shown) is provided for circulating liquid coolant through the rolls.

Fitting snugly into the converging space between the casting rolls on the left-hand, or entrance side thereof, is a pouring tip 14 made of heat-resistant material having insulation properties and also non-wettable by molten metal. The top and bottom surfaces of the tip 14 are formed with a cylindrical curvature at 16 and 18 to lie snugly against the outer surfaces of the respective rolls. An internal passageway 20 is provided in the pouring tip, and this passageway opens out at the tip end 22 into the space between the rolls.

The rolls 10, 12 are driven synchronously by power transmission means (not shown) in the direction indicated by the arrows, with the top roll 10 turning in the counterclockwise direction, and the bottom roll 12 turning clockwise. With the rolls turning as shown, molten metal from the pouring tip is carried through the space between the rolls, being solidified and hot rolled in the process, and issuing from the machine on the exit side of the rolls as a solid sheet, or strip 24.

In the drawing, it will be noted that the radius of the rolls is R; the distance that the tip 22 is set back from the roll centerline A—A is $L_1$; and the roll spacing at the centerline A—A is $T_1$. In the machine that has been built and tested extensively, the roll radius R is 18 inches; the tip setback $L_1$ has varied from 2.5 to 3 inches; and the roll spacing $T_1$ is 0.250 inches. These dimensions can be increased or decreased within certain limits, and will vary with different alloys of aluminum, or with different metals, such as zinc, for example. However, certain relationships must be maintained in order to practice the invention. These relationships will be given presently.

It has been learned from experience that when the rolls 10, 12 are turning at the optimum speed, molten aluminum freezes solidly across from one roll surface to the other at the vertical plane 26, shown at distance $L_2$ back from the roll centerline A—A. Distance $L_2$ has been determined by empirical means to be approximately 0.6 of $L_1$ for soft aluminum alloys, and therefore if $L_1$ is 2.5 inches, $L_2$ is 1.5 inches. The thickness of the metal at the point 26 is designated $T_2$, and this works out to 0.376 inches.

Another dimensional ratio that may help to distinguish the present invention from prior roll casting machines is the ratio of the thickness of the finished strip ($T_1$) to the thickness of the tip end 22 of the pouring spout 14. The tip end 22 is approximately 0.563 inch across (measured vertically in the drawing) and therefore the thickness $T_1$ of the finished strip is slightly less than half the thickness of the spout tip 22. Stated in another way, the reduction in thickness from the tip end 22 of the spout to the finished strip ($T_1$) is greater than 2, whereas in the Hunter caster and in other workable roll casters, the ratio has been appreciably less than 2 — more on the order of 1.5 or less. While this may appear to be a small difference, the resulting difference in the grain structure of the strip produced by the two machines is suprisingly and unexpectedly large.

As the molten metal issues from the pouring tip 14, it fills the converging space between the casting rolls 10, 12, and starts immediately to freeze at the area of contact with the roll surfaces. The thickness of the frozen metal on each roll surface increases as the rolls carry the metal toward the centerline A—A, and at point 26, the metal has solidifed across the entire space between the rolls. From point 26 to the roll centerline A—A, the frozen metal, which has already acquired the dendritic crystal structure of "as cast" metal, is reduced in thickness by hot rolling. The reduction in thickness is from 0.376 to 0.250 inches, which is approximately a 33% reduction. This is substantially greater than the 15 to 20% reduction of the Hunter caster, and exerts extremely high stress on the hot metal, causing the dentrites to fracture and creating a large multitide of recrystallization centers. The temperature of the metal between points 26 and the centerline A—A is in the neighborhood of 950°-1000° F, and the roll force required to produce the internal stresses necessary to fracture the dendrite crystals and to create the maximum number of recrystallization centers at this temperature is only a fraction of the roll force that would be required at a lower temperature. At the same time, the speed of recrystallization is at its maximum, as the temperature of the metal is close to the melting point.

Thus, the present invention realizes the perfect solution for continuously casting strip of the highest quality, and that is to simultaneously cast, solidify, heavily hot roll, and recrystallize the metal. This is accomplished by destroying the dendritic "as cast" crystal structure at the instant of its formation, and then replacing the "as cast"structure with a completely recrystallized new grain structure. The finished strip 24 has the extremely fine-grained, fully recrystallized structure that is otherwise formed only in metal that has been heavily hot-rolled after casting.

In order for the apparatus to be effective, it is necessary that certain conditions be observed. For soft aluminum alloys (e.g., 1100), the thickness $T_2$ of metal at point 26 should be equal to or greater than 1.5 times the dimension. I have obtained excellent results when casting 0.250 inch thick strip of this alloy, using a ratio of $L_2/T_2$ approximately equal to or slightly less than 4. As mentioned earlier, $L_2$ in my experimental machine is 1.5 inches, and $T_2$ is approximately 0.376 inches. One important factor that must be observed is that the pouring tip 22 should be set well back from the roll centerline A—A in order to allow the molten metal to freeze solidly across by the time it reaches point 26. Roll speed also enters into the consideration, as too slow roll speed will allow the metal to freeze solidly across, ahead of point 26, and this would greatly increase the roll-separating force, possibly leading to breakage of the rolls. The optimum roll speed with the dimensions shown is about 0.6 rpm. At this roll speed, and with the dimensions shown, the ration of $L_1/T_1$ is approximately equal to 10.

One important and characteristic feature of the invention that appears to be largely responsible for producing fine-grained, fully recrystallized structure in the finished strip, is the use of large-diameter rolls 10 and 12. In the embodiment shown and described herein, the rolls 10, 12 are 36 inches in diameter, where the Hunter caster has always been made with 24-inch diameter rolls. At first glance, the difference between 24-inch diameter rolls and 36-inch diameter rolls might seem to be almost without significance, yet the fact is that the larger diameter rolls of the present invention produce a dramatic and totally unexpected improvement in the grain structure of the finished product, in addition to providing a casting machine having the structural strength to stand up under the stresses that are produced.

It is a fact well known to designers of hot rolling mills, that small diameter rolls require less force than rolls of larger diameter to effect a given reduction. Small rolls lessen the separating force for two reasons: (1) the area of contact is less, so that, with a given pressure, the total force required is less; and (2) the pressure builds up to a lower peak because of the shorter distances through which friction acts. These principles influenced the design of the Hunter casting machine, which used the smallest diameter rolls consistent with the strength and rigidly needed, as the small-diameter rolls enabled the machine to operate with a lower power requirement. On the other hand, the larger diameter rolls of the present invention exert a considerably greater pressure on the metal, and use more power for a given reduction, as compared with the 24-inch diameter rolls of the Hunter caster. The additional power that goes into hot rolling is what causes the greatly increased internal stress within the metal that fractures and crushes the dendrite crystals and sets up the extremely large number of recrystallization centers. Thus, the large-diameter casting rolls constitutes the means by which a relatively large amount of power is expended in hot rolling the metal to effect a reduction of the order of 37 to 50%, so as to produce the high-level internal stressing necessary for complete recrystallization of the metal. At the same time, the increased diameter of the rolls gives them greater strength and rigidity to resist bending under the increased roll-separating force.

As stated earlier, the tip set-back $L_1$ on the machine shown and described herein is preferably about 2.50-inches. This distance has been experimentally increased to 3.00-inches or more, with the same 0.250-inch dimension for $T_1$, which increased the ratio $L_1/T_1$ to 12. However, when $L_1$ was increased to 3 inches, it was deemed advisable to increase the rotational speed of the rolls somewhat to avoid excessive roll-spreading force, due to the fact that the freezing point 26 might other-wise move back further from the roll centerline A—A, causing $T_2$ to increase to about 0.438-inch estimated distance. This would result in a hot-roll reduction$(T_1)/(T_2)_0$ of 57%, which is a fairly heavy reduction, and about the maximum that can be done without going to an excessively heavy and expensive roll construction. By speeding up the rolls to approximately 0.8 rpm, the freezing point 26 was found to be approximately at the same distance from the roll centerline A—A as before (i.e., $L_2$ = approximately 1.5 inches) and $T_2$ = approximately 1.5 $T_1$.

With all other parameters remaining constant, $L_2$ is increased by slowing down the rotational speed of the rolls, and is decreased by speeding up the rolls. The higher the roll speed, the greater the output. However, roll speed should preferably not be increased beyond the point where the metal freezes solidly across from one roll to the other at a point 26 where $T_2$ is appreciably less than 1.5 times $T_1$.

The point 26 where the metal freezes solidly across will also be changed by increasing or decreasing the rate of heat transfer from the molten metal to the rolls, which is a function of the thermal conductivity of the metal forming the roll shell. Thus, rolls having a copper shell would produce extremely fast chilling action, and this would have to be compensated for by driving the rolls at a faster speed, or by reducing the tip set-back $L_1$ so that the tip end 22 is closer to the freezing point 26. In that case, $L_2$ might have a considerably larger value than 0.6 $L_1$.

The above ratios are given to enable one skilled in the art to scale the casting machine up or down so as to produce thicker or thinner strip 24; or to drive the casting rolls 10, 12 at a higher or lower speed; or to otherwise modify the dimensions or other parameters of the machine.

While I have shown and described in considerable detail what I believe to be the preferred form of my invention, it will be understood by those skilled in the art that the invention is not limited to such details, but might take various other forms within the scope of the following claims.

I claim:

1. In apparatus for continuously casting metal in the form of a sheet or strip having exceedingly fine grain, said apparatus consisting of a pair of parallel casting rolls spaced apart slightly to receive molten metal between them, a pouring tip of heat-insulating material fitted snugly into the converging space between said casting rolls on one side thereof, and means for driving said rolls synchronously in the direction to carry the molten metal from said pouring tip through the space between said rolls, while heat is extracted from the molten metal, causing the same to solidify, the improvement comprising:

said casting rolls having a radius of not less than 18 inches and spaced apart approximately 0.250 inches at their closest point;

the pouring spout being positioned with its outer tip set back from the roll centerline a distance not less than 2.5 inches;

means adapted to drive said rolls at a speed of approximately 0.6 rpm; and means adapted to cool said rolls such that the molten metal freezes solidly across the space from one casting roll to the other at a point where the metal is approximately 0.375 inches thick, so that the solidified metal is hot-rolled down to 0.250 inch thickness.

* * * * *